US007436127B2

(12) United States Patent
Ribarich et al.

(10) Patent No.: US 7,436,127 B2
(45) Date of Patent: Oct. 14, 2008

(54) BALLAST CONTROL CIRCUIT

(75) Inventors: Thomas J. Ribarich, Laguna Beach, CA (US); Dana Wilhelm, Temple City, CA (US); Ying Xiao, El Segundo, CA (US)

(73) Assignee: International Rectifier Corporation, El Segundo, CA (US)

( * ) Notice: Subject to any disclaimer, the term of this patent is extended or adjusted under 35 U.S.C. 154(b) by 84 days.

(21) Appl. No.: 11/555,922

(22) Filed: Nov. 2, 2006

(65) Prior Publication Data

US 2007/0096662 A1 May 3, 2007

Related U.S. Application Data

(60) Provisional application No. 60/733,284, filed on Nov. 3, 2005.

(51) Int. Cl.
*H05B 37/02* (2006.01)

(52) U.S. Cl. ..... 315/291; 315/224; 315/209 T

(58) Field of Classification Search ..... 315/209 CD, 315/209 T, 209 R, 224–225, 291, 307–309
See application file for complete search history.

(56) References Cited

U.S. PATENT DOCUMENTS 5,742,134 A * 4/1998 Wacyk et al. ..... 315/307
6,008,590 A * 12/1999 Giannopoulos et al. . 315/209 R
6,020,689 A * 2/2000 Gradzki et al. ..... 315/224
6,211,623 B1 * 4/2001 Wilhelm et al. ..... 315/224
6,531,831 B2 * 3/2003 Chou et al. ..... 315/225
6,717,375 B2 * 4/2004 Noguchi et al. ..... 315/291
7,239,094 B2 * 7/2007 Radzinski et al. ..... 315/307

* cited by examiner

*Primary Examiner*—Thuy Vinh Tran
*Assistant Examiner*—Tung X Le
(74) *Attorney, Agent, or Firm*—Ostrolenk, Faber, Gerb & Soffen, LLP

(57) ABSTRACT

A ballast control circuit having a bridge driver for driving a transistor bridge of a ballast circuit coupled to a resonant ballast output stage including a lamp, the ballast control circuit comprising a circuit for setting a minimum oscillation frequency and a voltage controlled oscillation circuit having a first input, wherein as a voltage at the first input increases, modes of the circuit change from a preheat mode where the frequency of oscillation moves from a first frequency to a lower preheat frequency and continues at a substantially constant preheat frequency for a set duration of preheat time, to an ignition mode where the frequency moves lower towards a resonance frequency of the ballast output stage until the lamp ignites, and to a run mode where the frequency stops decreasing and stays at the minimum set frequency.

11 Claims, 10 Drawing Sheets

BALLAST CONTROL CIRCUIT

CROSS-REFERENCE TO RELATED APPLICATION

The present application claims the priority and benefit of U.S. Provisional Application Ser. No. 60/733,284, filed on Nov. 3, 2005, entitled ADAPTIVE BALLAST CONTROL IC, the entire disclosure of which is hereby incorporated by reference.

BACKGROUND OF THE INVENTION

The present invention relates to ballast control circuits having oscillators and more particularly to ballast control circuits having voltage controlled oscillators with an externally programmable minimum frequency and a fixed internal preheat frequency.

SUMMARY OF THE INVENTION

It is an object of the present invention to provide a ballast control circuit having a voltage controlled oscillator with an externally programmable minimum frequency and a fixed internal preheat frequency.

A ballast control circuit having a bridge driver for driving a transistor bridge of a ballast circuit coupled to a resonant ballast output stage including a lamp is disclosed. The ballast control circuit includes a circuit for setting a minimum oscillation frequency and a voltage controlled oscillation circuit having a first input, wherein as a voltage at the first input increases, modes of the circuit change from a preheat mode where the frequency moves from a first frequency to a lower preheat frequency and continues at a substantially constant preheat frequency for a set duration of preheat time, to an ignition mode where the frequency moves lower towards the resonance frequency of the ballast output stage until the lamp ignites, and then to a run mode where the frequency stops decreasing and stays at the minimum programmed frequency.

Preferably the circuit is implemented in an integrated circuit, and preferably an IC with only 8 pins.

Other features and advantages of the present invention will become apparent from the following description of the invention that refers to the accompanying drawings.

DETAILED DESCRIPTION OF EMBODIMENTS OF THE INVENTION

Figure 1:
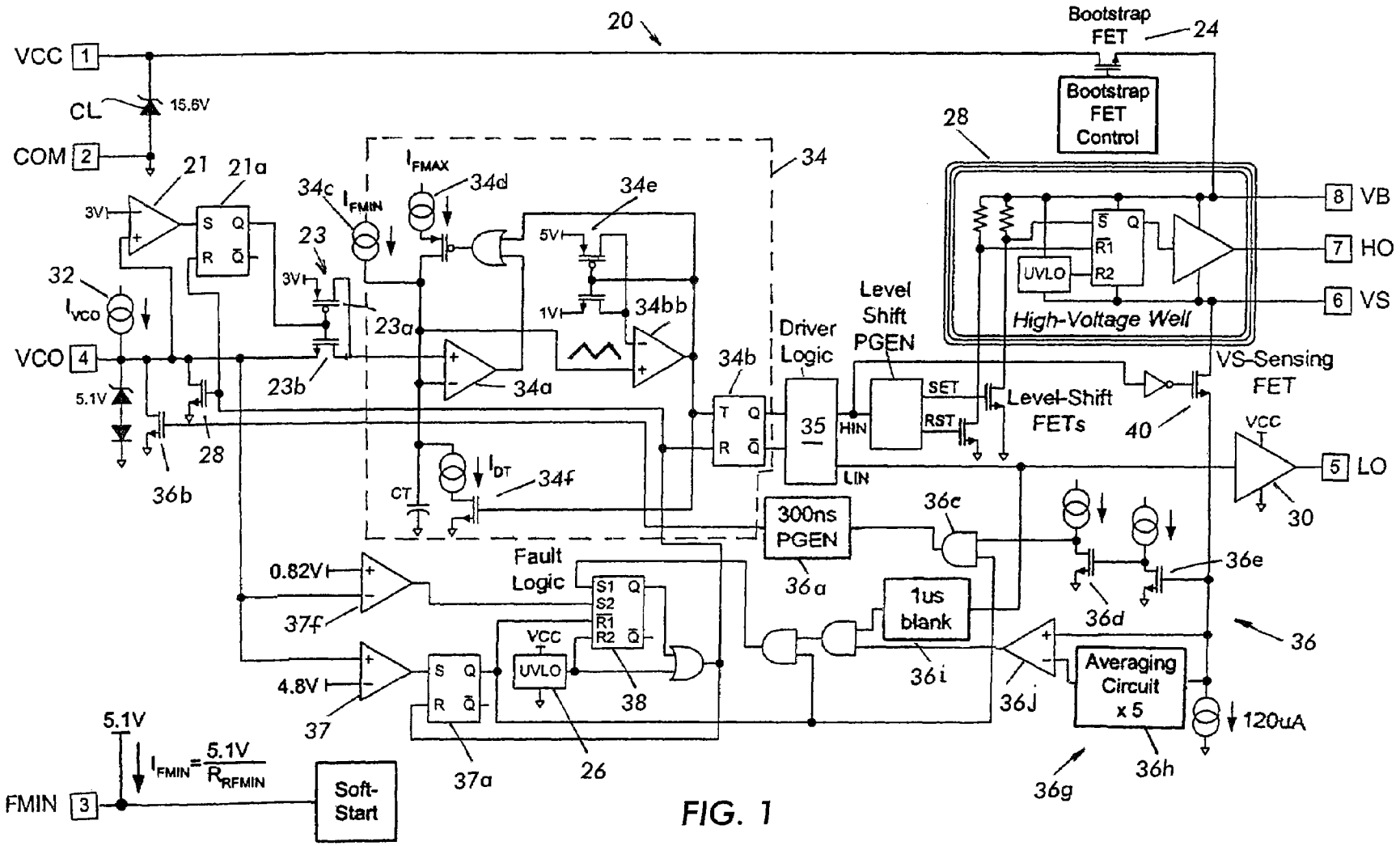
FIG. 1 is a circuit diagram of the ballast controller of the present invention.

As illustrated in FIG. 1, the present invention is a ballast controller and half-bridge driver integrated into a single IC 20 for fluorescent lighting applications, capable of driving a 600V half bridge. A compact fluorescent lamp is shown in the application circuit of FIG. 2. The IC 20 includes adaptive zero-voltage switching (ZVS), internal crest factor over-current protection, as well as an integrated bootstrap MOSFET 24. The IC 20 includes a voltage controlled oscillator 22 with externally programmable minimum frequency and fixed internal preheat frequency. All of the necessary ballast features can be integrated in an 8-pin DIP or SOIC package.

UVLO Mode

The IC 20 includes an under-voltage lockout mode (UVLO), which is defined as the state of the IC 20 when supply voltage $V_{CC}$ is below the turn-on threshold of the IC. The IC 20 UVLO circuit 26 is designed to maintain an ultra-low supply current, i.e., less than 200 μA, and to guarantee that the IC 20 is fully functional before high- and low-side output gate drivers at HO pin 7 and LO pin 5 are activated. As shown in FIG. 1, when UVLO circuit 26 output is high, flip flop 34*b* is set, stopping oscillation. Also switch 28 is turned on, discharging pin VCO. Flip flop 37*a* is also maintained in a reset state, disabling a pulse generator 36*a*, described later.

Figure 2:
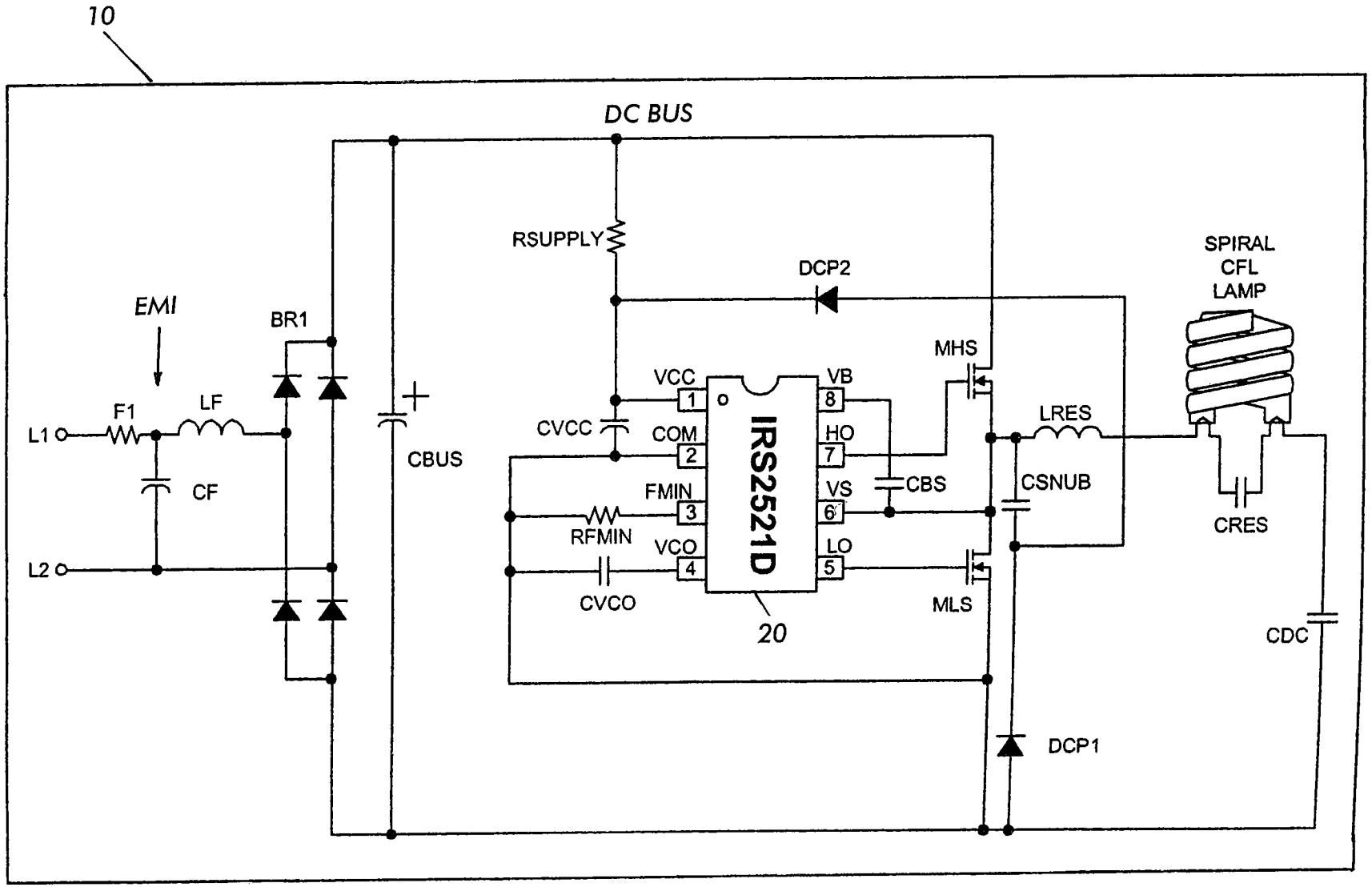
FIG. 2 is a circuit diagram showing a typical application of the ballast controller of the present invention.

FIG. 2 shows a typical application of the IC shown in FIG. 1. AC line voltage at L1, L2 is EMI filtered at EMI, rectified by bridge BR1, and the rectified DC is supplied to DC bus capacitor CBUS which establishes the DC bus voltage, which may be 600V. IC 20 has supply voltage VCC provided thereto by startup dropping resistor RSUPPLY with respect to common ground COM. A capacitor CVCC stores charge from the VCC supply during startup. A pin FMIN has a resistor RFMIN coupled thereto and to ground for setting the minimum operation frequency of the voltage controlled oscillator (VCO) of the ballast IC. Pin VCO has a charging/discharging capacitor CVCO coupled thereto for setting the voltage on pin VCO which sets the VCO frequency.

Pin $V_B$ provides a high side driver voltage generated by an internal bootstrap switch coupled to the bootstrap capacitor CBS having its low side coupled to the switched node return VS from the switched node of the ballast bridge transistor switches MHS and MLS. HO and LO are the gate drives to the ballast switches. The ballast circuit includes the two switches MHS and MLS, the resonant circuit including inductor LRES and capacitor CRES, the DC blocking capacitor CDC, the lamp CFL as well as snubber capacitor CSNUB and charge pump diodes DCP1 and DCP2.

Figure 3A:
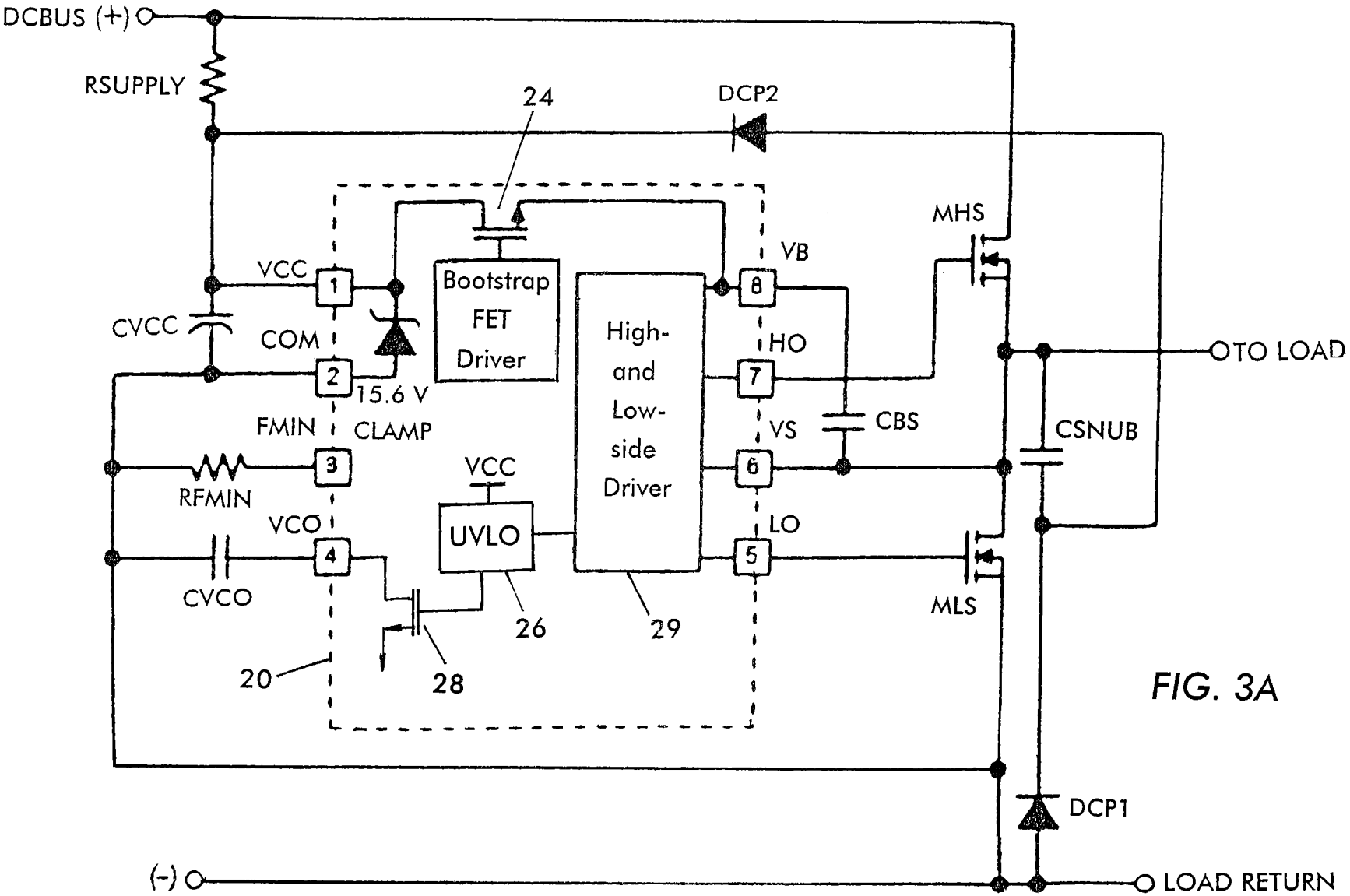
FIGS. 3*a*, 3*b*, and 3*c* are simplified circuit diagrams showing the connection of various internal circuits of the ballast controller of the present invention to an application circuit in different modes of operation.

As shown in FIGS. 2 and 3*a*, an external $V_{CC}$ capacitor CVCC is charged by a current through a supply resistor RSUPPLY, less the start-up current drawn by the IC 20. This resistor RSUPPLY is selected to provide sufficient current to supply the IC 20 from the DC bus. Once the capacitor voltage on $V_{CC}$ reaches the start-up threshold, UVLO+, the IC 20 turns on and the high- and low-side output gate drivers at HO pin 7 and LO pin 5 start oscillating. The capacitor CVCC should be large enough to hold the voltage at $V_{CC}$ above the UVLO+ threshold for one half-cycle of the line voltage or until the external charge pump auxiliary supply from diodes DCP1 and DCP2 can maintain the required supply voltage and current to the IC.

The internal bootstrap MOSFET 24 connected between VCC pin 1 and VB pin 8 and an external supply capacitor CBS determine the supply voltage for the high-side driver circuitry 28 of a high- and low-side driver 29 (FIG. 3*a*). An external charge pump circuit, including capacitor CSNUB and diodes DCP1 and DCP2, comprises an auxiliary voltage supply for the low-side driver circuitry 30 (FIG. 1) of the high- and low-side driver 29. To guarantee that the high-side supply is charged up before a pulse occurs on HO pin 7, a first pulse from the output drivers comes from LO pin 5. The low-side driver circuitry 30 may oscillate several times until a voltage difference between VB pin 8 and VS pin 6 exceeds the high-side UVLO rising threshold, e.g., UVBS+ (9 Volts), and the high-side driver circuit 28 is enabled. During the UVLO mode, the outputs of high- and low-side gate driver 29, at HO pin 7 and LO pin 5, are both low and VCO pin 4 is pulled down to COM by switch 28 for resetting the starting frequency to the maximum.

Preheat Mode

Figure 4A:
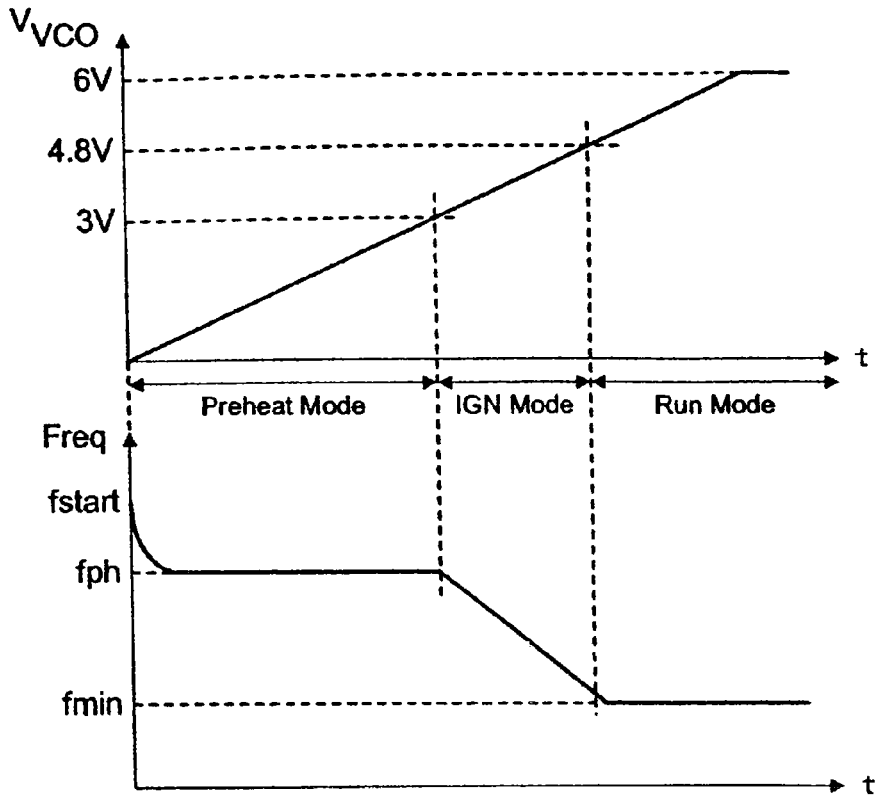
FIG. 4*a* is a graph showing changes in oscillation frequency as voltage at the VCO pin increases over time.

Turning to FIGS. 1, 2 and 3*a*, when $V_{CC}$ exceeds the UVLO+ threshold, the IC 20 enters a preheat mode and the high and low-side driver circuit 29 begins to oscillate at a high start frequency, $f_{start}$, see FIG. 4*a*. An internal current source 32 charges an external capacitor CVCO on VCO pin 4. Voltage on VCO pin 4 starts ramping up linearly (see FIG. 4*a*) and the frequency ramps down quickly from a high frequency ($2\times f_{MIN}$ or twice the minimum oscillating frequency) to the lower preheat frequency $f_{ph}$.

Figure 3B:
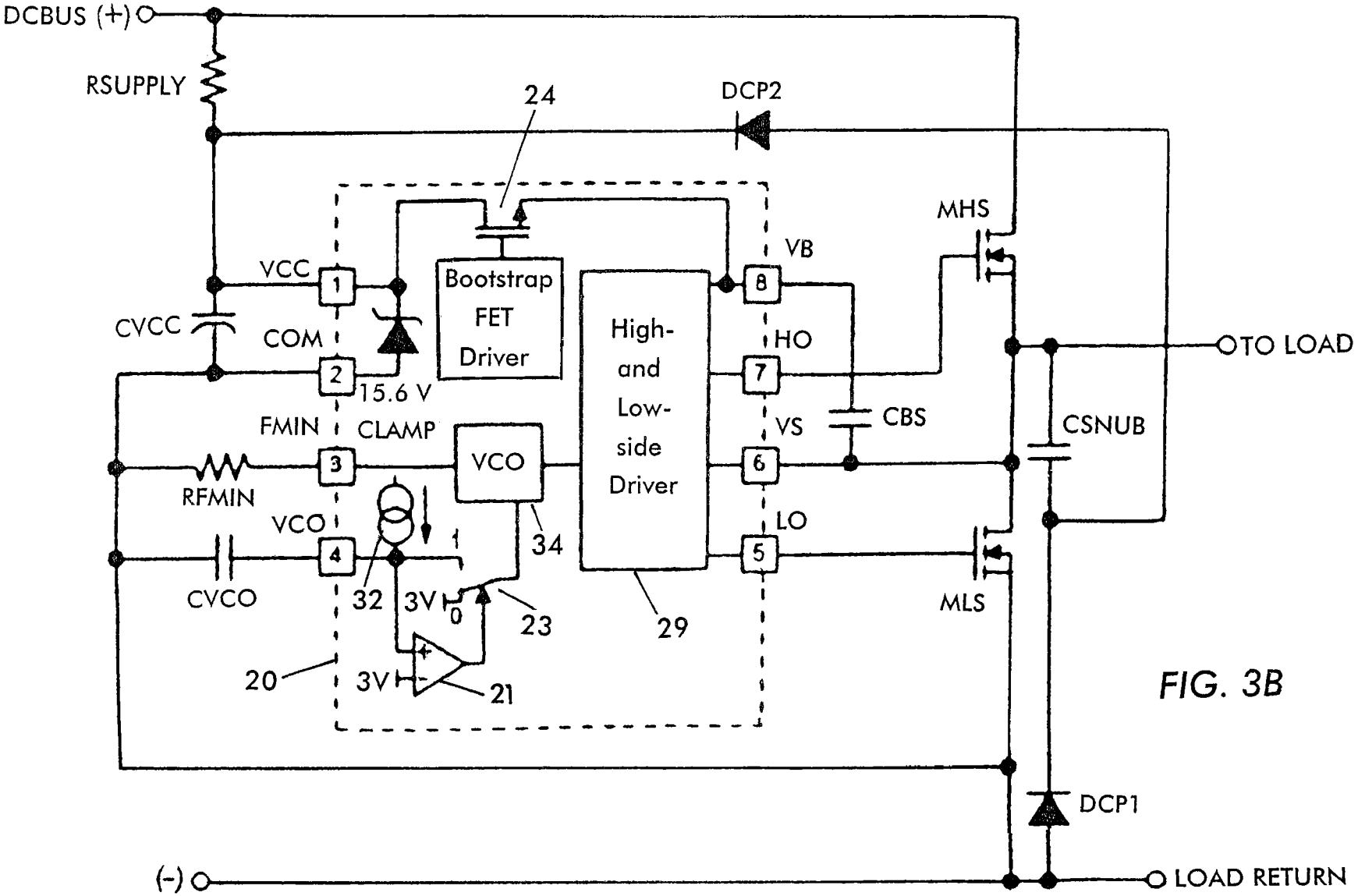

Turning to FIG. 3*b*, internally, the input of a VCO circuit 34 is held to 3V by a comparator 21 driving switch circuit 23 to keep the frequency at the preheat level $f_{ph}$, while the external VCO pin 4 continues to charge up from the internal current source 32. The preheat frequency is internally set to 1.5 times the minimum or run frequency. See FIG. 4*a*. The frequency remains at the preheat frequency until the voltage at VCO pin 4 exceeds 3V. When the voltage at VCO pin 4 exceeds 3V, the IC enters an ignition mode.

FIG. 2 shows a comparator 21, coupled to a 3 volt reference and having its other input tied to pin VCO. When the VCO pin voltage is below 3V, the comparator output is low, keeping flip flop 21*a* reset and thus keeping switch 23 on (switch 23*b* is off), providing 3 volts to the VCO comparator 34*a*. As soon as the VCO pin goes above 3V, the output of comparator 21 goes high, setting flip flop 21*a*, turning off switch 23*a* and turning on switch 23*b*, allowing the ramping VCO voltage on pin VCO to be applied to the VCO comparator 34*a*.

Ignition Mode

In the ignition mode, the input of the VCO circuit 34 is connected to the VCO pin 4, as described above, and the oscillation frequency of the VCO circuit 34 begins to ramp down, as the VCO pin 4 continues to charge up. FIG. 4*a* illustrates changes in oscillation frequency as the voltage of the VCO circuit 34 increases over time as the IC 20 moves from the preheat mode, to the ignition mode and then to a run mode. The graph shows that as the VCO pin continues to charge up linearly, from 0V to 3V to 4.8V to eventually 6V in the run mode, the frequency moves down towards the resonance frequency of the high-Q ballast output stage causing the lamp voltage and load current to increase. The voltage on VCO pin 4 continues to increase and the frequency continues to decrease until the lamp ignites. If the lamp ignites successfully, the voltage on VCO pin 4 continues to increase until it reaches an internal limit of 6V. The frequency stops decreasing and stays at the minimum frequency as programmed by an external resistor RFMIN on FMIN pin 3.

VCO 34, as shown in FIG. 1, may comprise two comparators 34*a* and 34*bb*. Current source 34*c* and 34*d* determine the minimum and maximum currents that charge a timing capacitor CT of the VCO. A switching circuit 34*e* controlled by the VCO output determines the comparator 34*bb* switching points based on 1 and 5 volt references. When the output of comparator 34*bb* goes high, it discharges capacitor CT via switch 34*f* to start the oscillatory period again. A sawtooth is present at the non-inverting input of comparator 34*bb* and switching occurs at 5V and 1V, resulting in a square wave at the output of the comparator 34*bb*.

Figure 4B:
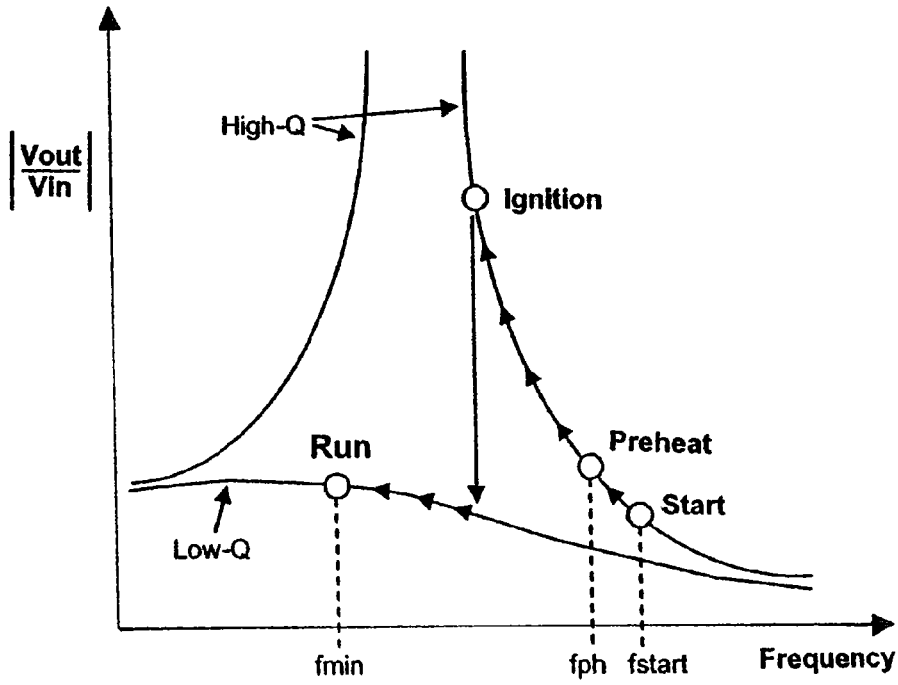
FIG. 4*b* is a graph showing frequency versus transfer function, illustrating the various modes of operation and showing the high-Q resonance frequency of the ballast output stage and how the frequency moves through resonance for lamp ignition.

As illustrated in FIG. 4*b*, the minimum frequency should be set below the high-Q resonance frequency of the ballast output stage to ensure that the frequency ramps through resonance for lamp ignition. The preheat time is set with the external capacitor CVCO (FIGS. 2 and 3*a*-3*b*) and should be long enough to adequately heat the lamp filaments to their correct emission temperature for maximizing lamp life. FIG. 4*b* shows the resonance curve spread out for clarity, but the actual frequency during preheat mode is substantially practically constant.

Run Mode

As seen in FIG. 4*a* the IC 20 enters the run mode when the voltage on the VCO pin exceeds 4.8V. The lamp has ignited and the ballast output stage becomes a low-Q, series-L, parallel-RC circuit.

Figure 3C:
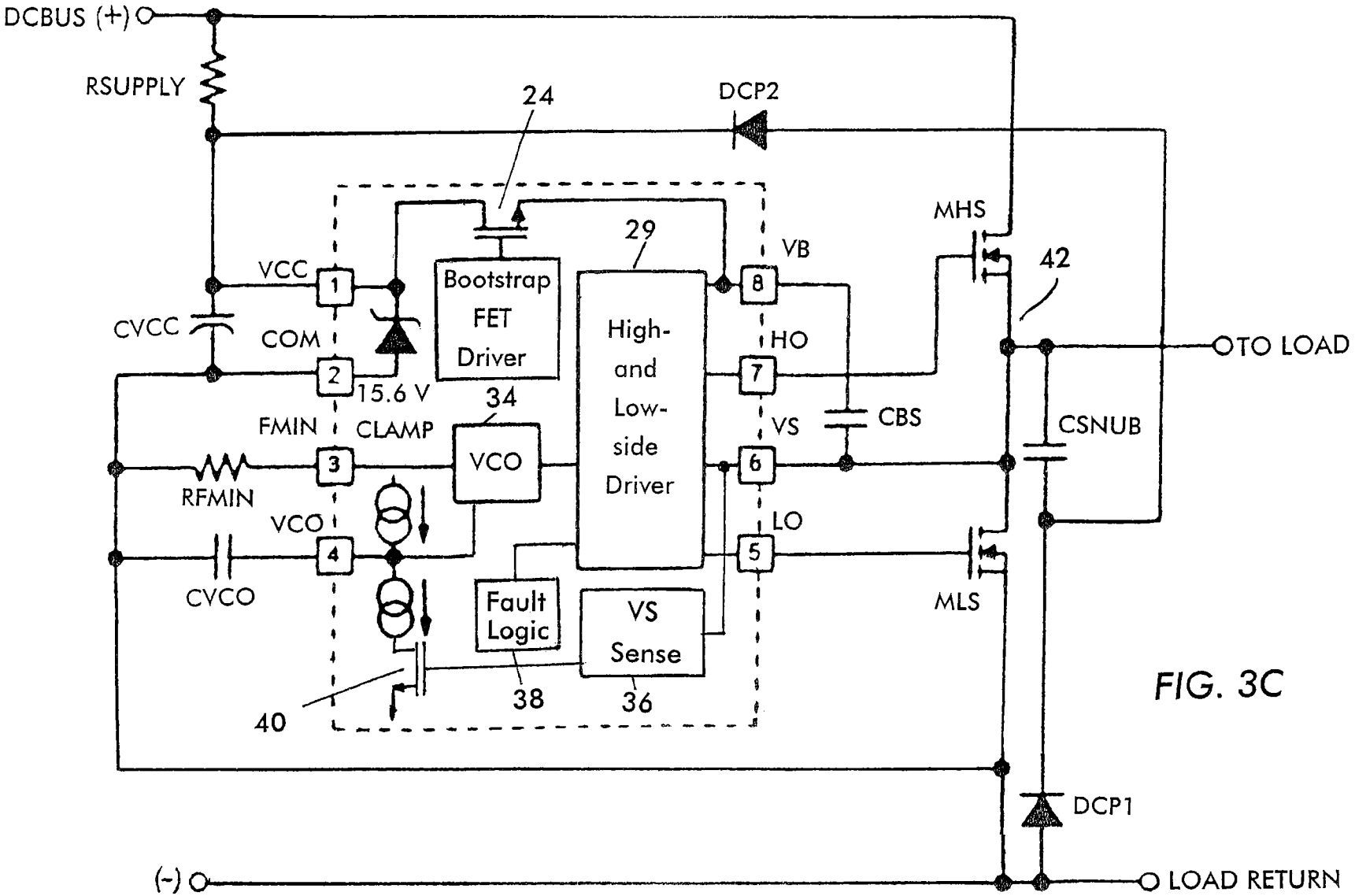

When VCO reaches 4.8V, comparator 37 goes high, setting flip flop 37*a*, and resetting fault logic 38 at one of the reset pins R1. The set output of flip flop 37*a* also enables the pulse generator 36*a* via gate 36*c*, to be described later in connection with ZVS. Also, VS sensing circuit 36 and fault logic circuit 38, illustrated schematically in FIG. 3*c*, both become enabled for protection against non-ZVS and over-current fault conditions. The voltage on VCO pin 4 continues to increase until the voltage on VCO pin 4 limits at 6V. In the run mode, the minimum frequency FMIN is reached. The resonant inductor LRES, resonant capacitor CRES, DC bus voltage and minimum frequency FMIN determine the running lamp power. The IC 20 stays at this minimum frequency unless non zero-voltage switching (non-ZVS) occurs at VS pin 6, a crest factor over-current condition is detected at VS pin 6, or $V_{CC}$ decreases below the UVLO− threshold.

Non ZVS Protection

Figure 5A:
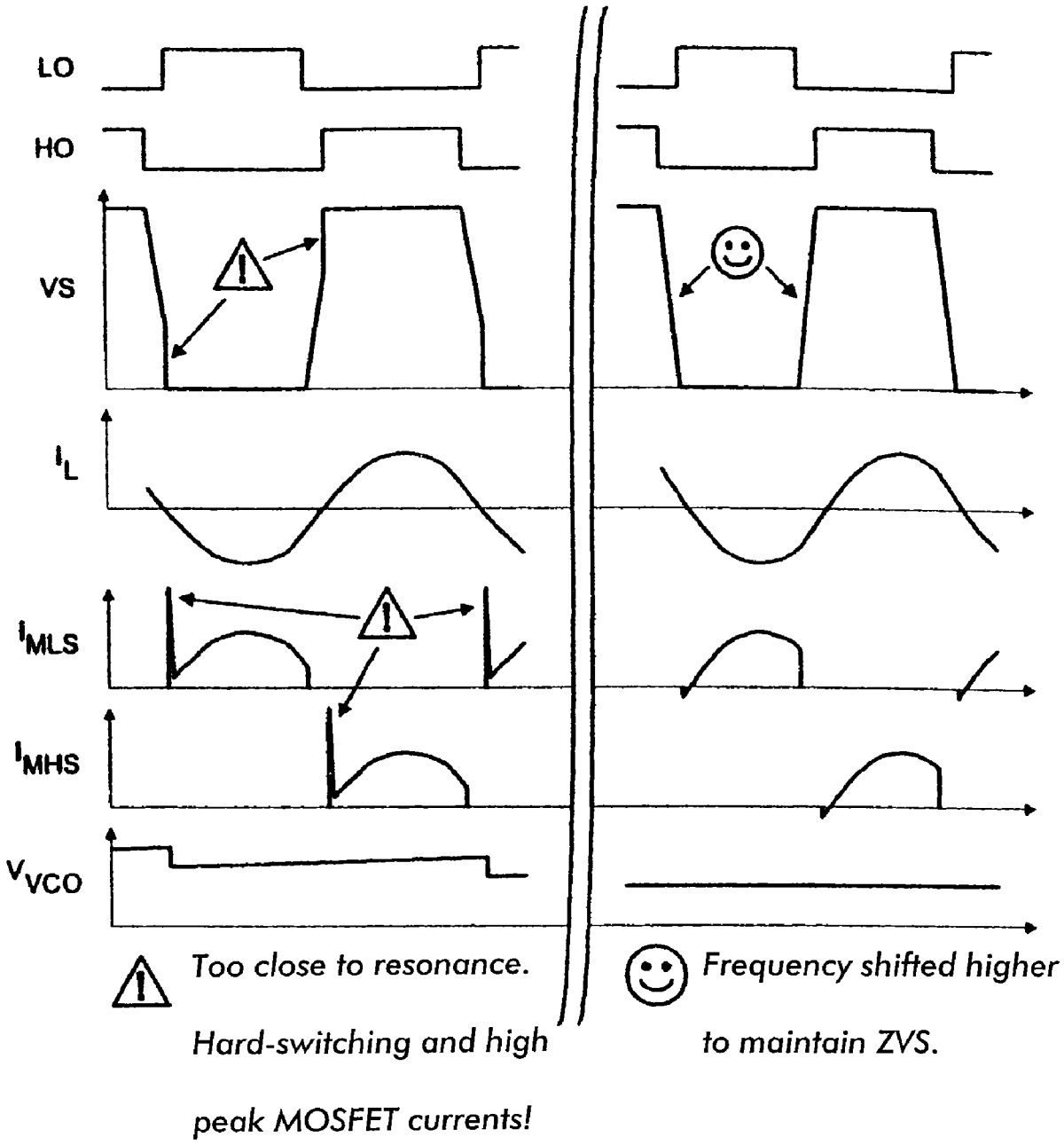
FIG. 5*a* is a graph showing voltage at pins of the inventive IC and current through the switches of the half-bridge and the load, illustrating both non-ZVS capacitive-mode switching that can damage the switches of the half-bridge by causing high peak currents to flow in the switches as well as ZVS switching.

During the run mode, if the voltage at VS pin 6 has not slewed entirely to COM during the dead-time such that there is voltage between the drain and source of the external low-side half-bridge 42 MOSFET when LO pin 5 turns-on, then the circuit 10 is operating too close to, or on the capacitive side of resonance. The left side of FIG. 5*a* illustrates the result, which is a non-ZVS capacitive-mode switching that causes high peak currents to flow in the half-bridge 42 MOSFETs MHS and MLS that can damage or destroy them. This can occur due to a lamp filament failure(s), lamp removal (open circuit), a dropping DC bus during a mains brownout or mains interrupt, lamp variations over time, or component variations. To protect against this, an internal high-voltage MOSFET 40 is turned on by driver logic 35 at the turn-off of HO and the VS-sensing circuit 36 measures voltage at VS pin 6 at each rising edge of a signal provided by the low-side driver circuit 30 to LO pin 5. If the voltage at VS pin 6 is non-zero, a pulse of current supplied when pulse generator 36*a* turns on switch 36*b* is sinked from VCO pin 4 to slightly discharge the external capacitor CVCO, causing the frequency to increase slightly. Then during the rest of the cycle, the capacitor CVCO charges up slowly due to the internal current source. This is shown in FIG. 5*a*, on the right side.

Pulse generator 36*a* provides a pulse when gate 36*c* is enabled by the output of flip-flop 37*a* (when in run mode) and sufficient voltage is present at mode $V_S$ (when switch 40 is turned on when HO goes low) to turn on switches 36*d* and 36*e*.

Figure 5B:
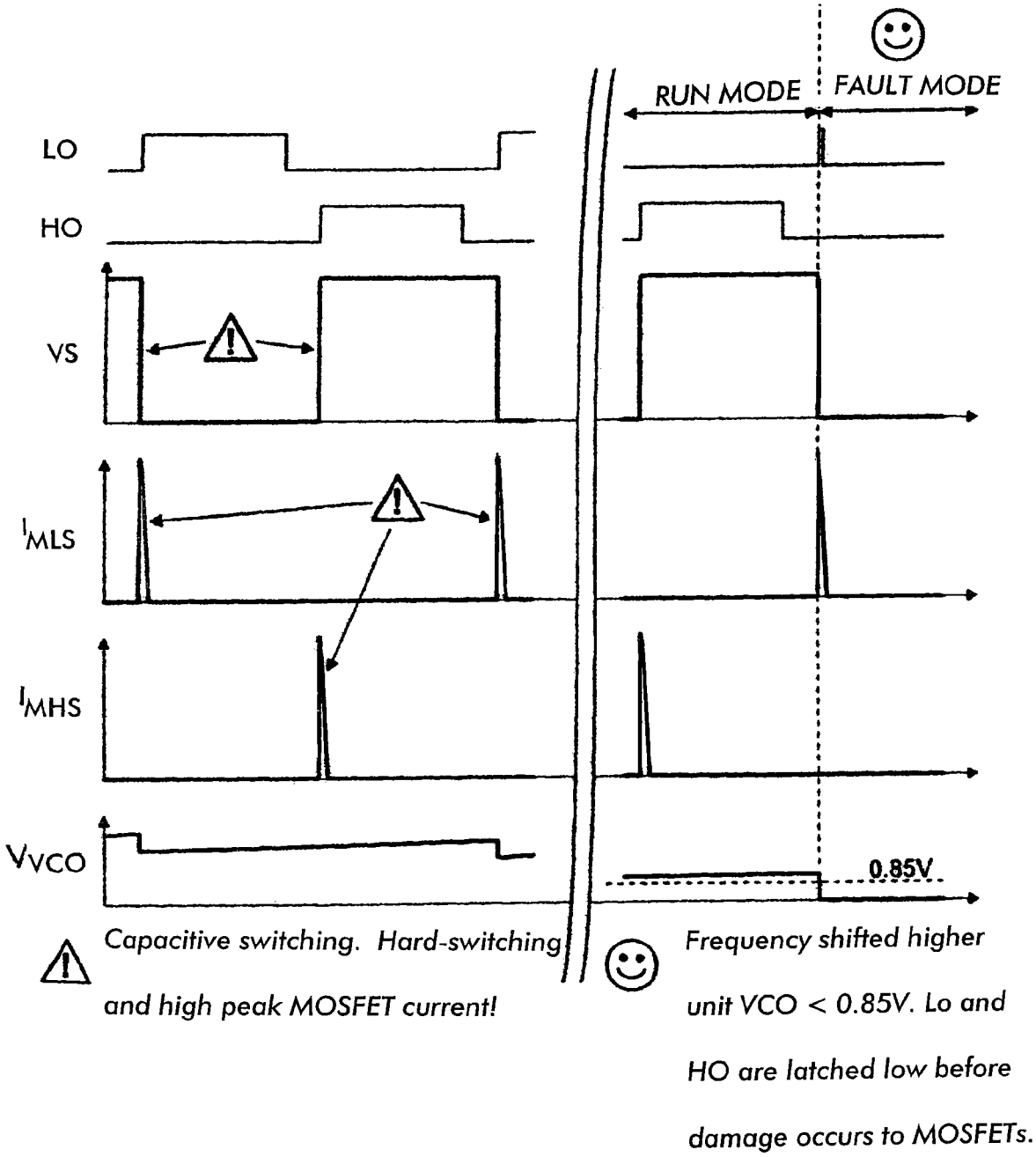
FIG. 5*b* is a graph showing voltage at pins of the inventive IC and current through the switches of the half-bridge and the load during a lamp removal or filament failure.

The frequency is trying to decrease towards resonance by charging the capacitor CVCO and the adaptive ZVS circuit "nudges" the frequency back up slightly above resonance each time non-ZVS is detected at the turn-on of the low-side driver circuit 30. The internal high-voltage MOSFET 40 is then turned off at the turn-off of the low-side driver circuit 30 and it withstands the high-voltage when voltage at VS pin 6 slews up to the DC bus potential. The circuit then remains in this closed-loop adaptive ZVS mode during running and maintains ZVS operation with changing line conditions, component tolerance variations and lamp/load variations. As illustrated in FIG. 5*b*, during a lamp removal or filament failure, the lamp resonant tank will be interrupted causing the half-bridge output to load to go open circuit. This will cause capacitive switching (hard-switching) resulting in high peak MOSFET currents that can damage them, as shown on the left side of FIG. 5*b*. The IC 20 will increase the frequency in an attempt to satisfy ZVS until VCO pin 4 decreases below 0.82V. Comparator 37*f* will cause the IC 20 to enter a fault mode (setting fault logic 38 via set input S2) and latch the outputs of the high 28 and low side drivers 30 at HO pin 7 and LO pin 5 'low' for turning the half-bridge 42 off safely before any damage can occur to the MOSFETs MHS and MLS.

Crest Factor Over-Current Protection

During normal lamp ignition, the frequency sweeps through resonance and the output voltage increases across the resonant capacitor and lamp until the lamp ignites. If the lamp fails to ignite, the resonant capacitor voltage, the inductor voltage, and the inductor current will continue to increase until the inductor saturates or an output voltage exceeds the maximum voltage rating of the resonant capacitor or inductor.

The ballast must be shutdown before any damage can occur. To protect against a lamp non-strike fault condition, the IC 20 uses the VS-sensing circuitry 36 (FIGS. 1, 3*c*) and in particular circuit 36*g* (FIG. 1) to measure the low-side half-bridge MOSFET current for detecting an over-current fault. By using the RDSon of the external low-side MOSFET for current sensing and the VS-sensing circuitry 36, the IC 20 eliminates the need for an additional current sensing resistor, filter and a current-sensing pin.

Figure 6:
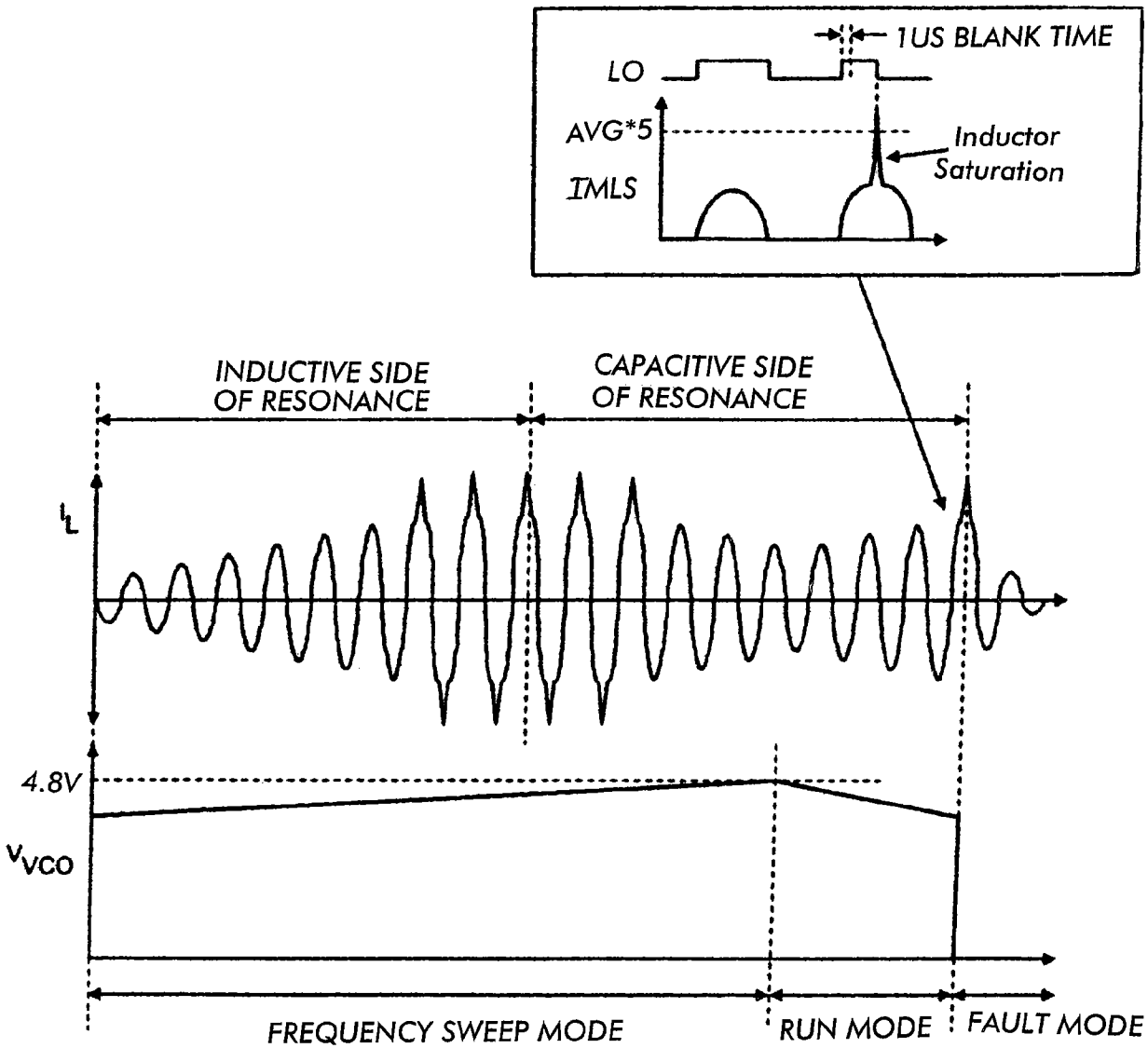
FIG. 6 is a graph showing the relationship of resonant tank current and voltage on the VCO pin of the control IC and illustrating how crest factor protection is achieved.

To cancel changes in the RDSon value due to temperature and MOSFET variations, the IC 20 performs a crest factor measurement via 36*g* that detects when the peak current exceeds the average current by a factor of 5. Measuring the crest factor is ideal for detecting when the inductor saturates due to excessive current that occurs in the resonant tank when the frequency sweeps through resonance and the lamp does not ignite. As illustrated in FIG. 6, when the voltage on VCO pin 4 ramps up for the first time from zero, the resonant tank current $I_L$ and voltages increase as the frequency decreases towards resonance.

If the lamp does not ignite, the inductor current will eventually saturate. But the crest factor fault protection is not active until the voltage on VCO pin 4 exceeds 4.8V for the first time. The frequency will continue to decrease to the capacitive side of resonance towards the minimum frequency setting and the resonant tank current and voltages will decrease again. When the voltage on VCO pin 4 exceeds 4.8V (see comparator 37 of FIG. 1), the IC 20 will enter the run mode and the non-ZVS protection and crest factor protection are both enabled. The non-ZVS protection will increase the frequency again, cycle-by-cycle towards resonance from the capacitive side. The resonant tank current will increase again as the frequency nears resonance until the inductor saturates again. The crest factor protection will be enabled and measures the instantaneous voltage at VS pin 6 only during the time when the signal on LO pin 5 is 'high' and after an initial 1 us blank time (see pulse generator 36*i*) from the rising edge of the signal on LO pin 5. The blank time is necessary to prevent the crest factor protection circuit from reacting to a non-ZVS condition.

An averaging circuit 36*h* averages the instantaneous voltage at VS pin 6 over 10 to 20 switching cycles of the signal on LO pin 5. During the run mode, the first time the inductor saturates when the signal on LO pin 5 is 'high' (after the 1 us blank time) and the peak current exceeds the average by 5 as determined by a comparator 36*j*, the IC 20 will enter the fault mode via set input S1 of fault logic 38 and both LO pin 5 and HO pin 8 outputs will be latched 'low'.

The half-bridge will be safely disabled before any damage can occur to the ballast components. As FIG. 6 shows, the crest factor peak-to-average fault factor varies as a function of the internal average. The maximum internal average should be below 3.0 volts. Should the average exceed this amount, the multiplied average voltage can exceed the maximum limit of the VS sensing circuit 36 and the VS sensing circuit 36 will no longer detect crest factor faults. This can occur when a half-bridge MOSFET is selected that has an RDSon that is too large for the application, causing the internal average to exceed the maximum limit.

Fault Mode

During the run mode, decrease of the voltage on VCO pin 4 below 0.85V, or, occurrence of a crest factor fault, will cause the IC 20 to enter the fault mode via fault logic 38. This will force both the low- and high-side gate driver outputs to be latched 'low' so that the half-bridge is disabled. VCO pin 4 is pulled low to COM by switch 28 and voltage on FMIN pin 3 also decreases from 5V to COM. VCC draws micro-power current so that VCC stays at the clamp CL voltage and the IC remains in the fault mode without the need for the charge-pump auxiliary supply. To exit the fault mode and return to the preheat mode, $V_{CC}$ must be cycled below the UVLO− threshold and back above the UVLO+ threshold.

Figure 7:
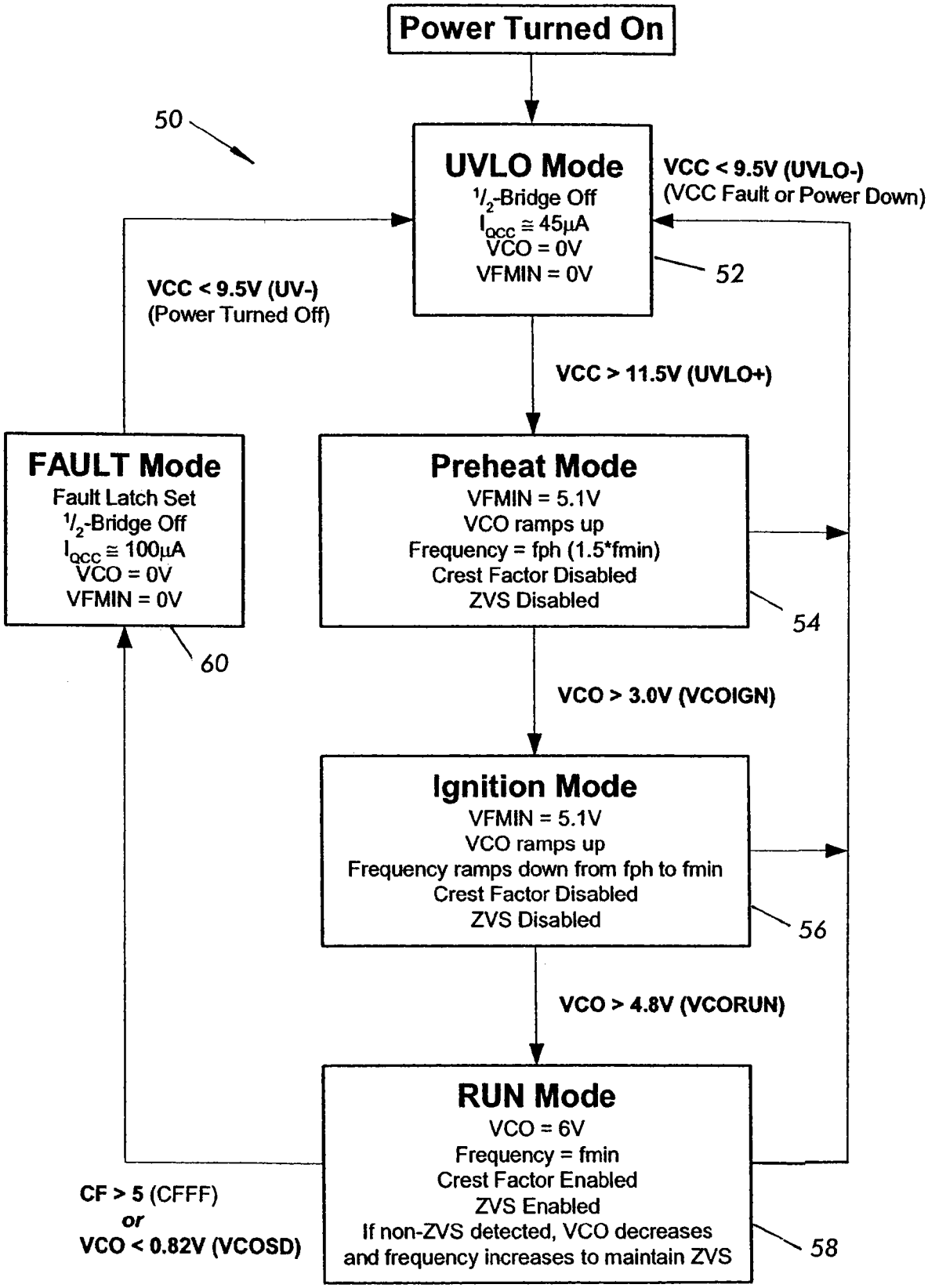
FIG. 7 is a state diagram of the various modes of the circuit of the present invention.

The modes of the IC 20 and their transition will now be described with reference to a state diagram 50 of FIG. 7. The processing of the IC 20 begins in the UVLO mode 52. After the power is turned on, the half bridge is Off; $I_{QCC}$≈45 uA; the voltage at VCO pin 4 is 0V; and voltage at FMIN pin 3 is 0V.

When $V_{CC}$ becomes greater than the UVLO+ threshold of 11.5V, the IC 20 enters the preheat mode 54. In the preheat mode 54 a voltage at FMIN pin 3 is 5.1V, a frequency that is equal to oscillator preheat frequency (1.5* minimum oscillator frequency); and crest factor and ZVS are disabled. At these settings VCO ramps up.

When the voltage at VCO pin 4 becomes greater than a VCOIGN threshold of 3.0V, the IC 20 enters the ignition mode 56. In the ignition mode 56 the voltage at FMIN pin 3 is 5.1V; VCO ramps up; the frequency ramps down from oscillator preheat frequency to minimum oscillator frequency; crest factor and ZVS are disabled.

When the voltage at VCO pin 4 becomes greater than a VCORUN threshold of 4.8V, the IC 20 enters the run mode 58. In the run mode 58 the voltage at VCO pin 4 is 6V; the frequency is equal to fmin; crest factor and ZVS are enabled. Additionally, if non-ZVS is detected, the voltage at VCO pin 4 decreases and the frequency increases to maintain ZVS.

When the voltage at VCO pin 4 decreases to become less than a VCOSD threshold of 0.82V or a Crest Factor is greater then a CFFF (crest factor peak-to-average fault factor) threshold of 5, the IC 20 enters the fault 60 mode. In the fault mode 60 a fault latch is set, the half bridge is Off; $I_{QCC}$≈100 uA; the voltage at VCO pin 4 is 0V; and voltage at FMIN pin 3 is 0V.

Finally, if while in any of the above modes, the IC 20 experiences $V_{CC}$ decrease to less than the UVLO− threshold of 9.5V, indicating $V_{CC}$ fault or that the power is turned OFF, the IC 20 returns to the UVLO mode 52.

Although the present invention has been described in relation to particular embodiments thereof, many other variations and modifications and other uses will become apparent to those skilled in the art. It is preferred, therefore, that the present invention not be limited by the specific disclosure herein.

What is claimed is:

1. A ballast control circuit having a bridge driver for driving a transistor bridge of a ballast circuit coupled to a resonant ballast output stage including a lamp, the ballast control circuit comprising:

a circuit for setting a minimum oscillation frequency; and a voltage controlled oscillation circuit having a first input, wherein as a voltage at the first input increases, modes of the ballast control circuit change from a preheat mode where the frequency of oscillation moves from a first frequency to a lower preheat frequency and continues at a substantially constant preheat frequency for a set duration of preheat time, to an ignition mode where the frequency moves lower towards a resonance frequency of the ballast output stage until the lamp ignites, and to a run mode where the frequency stops decreasing and stays at the minimum set frequency.

2. The circuit of claim 1, further comprising a second input coupled to said setting circuit for setting said minimum oscillation frequency.

3. The circuit of claim 1, further comprising an internal current source that charges an external capacitor on the first input, a voltage on the capacitor setting the preheat time.

4. The circuit of claim 1, wherein a voltage at the first input increases from a first value at a start of the preheat mode, to a second value at a start of the ignition mode to a third value at a start of the run mode, and to a fourth value at which the increase of the voltage at the first pin stops but the run mode continues.

5. The circuit of claim 1, wherein the first frequency is a first multiple of the minimum oscillation frequency and the preheat frequency is internally set to a second multiple of the minimum oscillation frequency.

6. The circuit of claim 5, wherein the first multiple is about 2 and the second multiple is about 1.5.

7. The circuitry of claim 1, further comprising a circuit connected between said first input and said voltage controlled oscillation circuit for maintaining the voltage at an input to the voltage controlled oscillation circuit at a fixed voltage during said preheat time while the voltage at said first input changes thereby maintaining the frequency of oscillation of said voltage controlled oscillation circuit substantially constant during said preheat time.

8. The circuit of claim 1, wherein during the ignition mode, the frequency moves lower, causing the lamp voltage and lamp current to increase.

9. The circuit of claim 1, wherein during the ignition mode, the minimum frequency is set below the resonance frequency of the ballast output stage to ensure that the frequency moves through resonance for lamp ignition.

10. The circuit of claim 1, wherein in the run mode, a voltage switching sensing circuit and a fault logic circuit are enabled for protecting the circuit against non-zero-voltage switching and over-current fault conditions.

11. The circuit of claim 1, packaged as an integrated circuit.

* * * * *